United States Patent [19]

Audeh et al.

[11] 4,434,046

[45] Feb. 28, 1984

[54] PREVENTING PHASE SEPARATION OF DEWAXED OIL

[75] Inventors: Costandi A. Audeh, Princeton; David S. Shihabi, Pennington, both of N.J.

[73] Assignee: Mobil Oil Corporation, New York, N.Y.

[21] Appl. No.: 259,292

[22] Filed: Apr. 30, 1981

[51] Int. Cl.[3] ..... C10G 11/5; C10G 47/16

[52] U.S. Cl. ..... 208/111; 208/28; 208/120; 208/95

[58] Field of Search ..... 208/111, 20, 26, 28, 208/310 Z

[56] References Cited

U.S. PATENT DOCUMENTS

| | | | |
|---|---|---|---|
| 3,684,685 | 8/1972 | Herbstman et al. | 208/37 |
| 3,729,414 | 4/1973 | Harris et al. | 210/66 |
| 3,755,138 | 8/1973 | Chen et al. | 208/111 X |
| 3,876,533 | 4/1975 | Myers | 208/88 X |
| 4,263,129 | 4/1981 | Chen et al. | 208/111 |
| 4,269,697 | 5/1981 | Chen et al. | 208/120 |
| 4,309,281 | 1/1982 | Dessau | 208/310 Z |

*Primary Examiner*—Delbert E. Gantz
*Assistant Examiner*—George Schmitkons
*Attorney, Agent, or Firm*—Alexander J. McKillop; Michael G. Gilman; Howard M. Flournoy

[57] ABSTRACT

Crude oil, when mildly dewaxed in the absence or presence of added hydrogen, separates into two phases with different pour points. A filtration step, which removes less than 5 percent of the product as solids, prevents this phase separation.

6 Claims, No Drawings

PREVENTING PHASE SEPARATION OF DEWAXED OIL

BACKGROUND OF THE INVENTION

1. Field of the Invention

The invention relates to improving the transportability of crude oils by pipeline. More particularly, it relates to a two-step process of catalytically dewaxing the crude under mild conditions, followed by filtration to remove a small solids fraction.

2. Discussion of the Prior Art

It is known that some crude oils contain a large amount of wax such that these crudes solidify at ambient temperatures and become difficult to handle in a pipeline or in other modes of transport. With respect to transport by pipeline, the traditional method of solving the problem was to apply heat to melt the wax, followed by pipelining in steam-traced and well-insulated pipelines.

It is not new to filter crude oil. As is taught in U.S. Pat. No. 3,729,414, in the early dewaxing procedures, the wax was crystallized by slow cooling and was separated from the oil by filtering, etc. The earliest process for this purpose was practiced in the oil fields and was called cold settling. A later process applied to light lube distillates involved slowly cooling the oil and filtering to remove the wax formed.

Nor is it new to dewax the crude using a catalyst, such as ZSM-5. This aspect is taught, for example, in U.S. Pat. No. 3,755,138, in which a two-step dewaxing process is disclosed. The process involves (1) solvent dewaxing followed by (2) hydrodewaxing over a ZSM-5 type zeolite.

SUMMARY OF THE INVENTION

In accordance with the invention there is provided an improvement in a process of preparing a crude oil for transport, particularly in a pipeline, the improvement comprising (1) contacting a crude oil with a crystalline aluminosilicate zeolite having a $SiO_2$ to $Al_2O_3$ ratio of at least 12 and a Constraint Index of 1 to 12, the contact being made in the absence or presence of added hydrogen, and (2) filtering the dewaxed oil.

DISCUSSION OF SPECIFIC EMBODIMENTS

Some crudes contain an excessive amount of generally branched paraffin wax. Because of this, catalytic dewaxing is generally not effective and gives rise to a non-uniform product. This problem could be solved by the use of the more severe hydrodewaxing process, but this would in turn give rise to the difficult problems of hydrogen supply in the producing areas and to the destruction of valuable waxes. Also more severe processing results in the production of an excessive amount of dry gas which in turn makes the severe process undesirable.

As the crude is produced, it reaches the storage tanks above its melting point and is usually stored in well-insulated tanks. This crude in the form of liquid is processed over a catalyst, for example, NaZSM-5 or presteamed NaZSM-5, steamed or unsteamed HZSM-5, MDDW type catalysts or any shape selective catalysts, under mild conditions, i.e., a pressure from about 50 to about 500 psig, an LHSV of from about 0.1 to about 2 LHSV and a temperature of from bout 500° F. to about 800° F., preferably about 0.8 to 1.2 LHSV, about 375 to 450 psig and about 700° to 750° F., respectively. The product from this process is a dewaxed crude that contains a residual amount of wax that results upon cooling to ambient temperature in the separation of two distinct phases, a low pour point phase and a high pour point phase.

In one aspect, the zeolites useful herein may be identified in terms of mole ratios of oxides substantially as follows:

$$\leqq 1.3\ M_{\frac{2}{n}}O:W_2O_3:xYO_2:zH_2O$$

wherein M is a cation, n is the valence of said cation, W is a trivalent metal atom from Groups III through VIII of the Periodic Table or mixtures of such atoms, including, for example, Groups IIIB (e.g., aluminum, gallium, and boron), Group VIA (e.g., chromium) and Group VIII (e.g., iron), Y is silicon or germanium, x is greater than 5 and z is 0 to 40.

Preferably, the mole ratio will be as follows:

$$\leqq 1.3\ M_{\frac{2}{n}}O:W_2O_3:xYO_2:zH_2O$$

where M, n, W and z are as just defined and x is greater than 12. In a preferred synthesized form, the zeolite has a formula, in terms of mole ratios of oxides, as follows:

$$\leqq 1.3\ M_{\frac{2}{n}}O:Al_2O_3:xSiO_2:zH_2O$$

where M is a mixture of alkali metal cations, especially sodium, and alkylammonium cations, the alkyl groups of which preferably contain from 2 to 5 carbon atoms, and x is greater than 12.

In a preferred embodiment, the zeolite is ZSM-5, W is aluminum, Y is silicon and the silica/alumina ratio is at least 12 and can range up to 4000 or more.

Thus, in general the term "zeolite" herein defines a natural or synthetic porous tectosilicate characterized by having a rigid crystalline framework structure composed of an assembly of silicon atoms and at least a trace amount of a trivalent metal atom, preferably aluminum, but which can also be iron, boron, gallium, chromium, and the like, or mixtures thereof, the silicon atoms and trivalent metal atoms each being surrounded by a tetrahedron of shared oxygen atoms, and a precisely defined pore structure.

The crystalline zeolites utilized herein are more particularly members of a novel class of zeolitic materials which exhibit unusual properties. Although these zeolites have unusually low alumina contents, i.e. high silica to alumina mole ratios, they are very active even when the silica to alumina mole ratio exceeds 30. The activity is surprising since catalytic activity is generally attributed to framework aluminum atoms and/or cations associated with these aluminum atoms. These zeolites retain their crystallinity for long periods in spite of the presence of steam at high temperature which induces irreversible collapse of the framework of other zeolites, e.g. of the X and A type. Furthermore, carbonaceous deposits, when formed, may be removed by burning at higher than usual temperatures to restore activity. These zeolites, used as catalysts, generally have low coke-forming activity and therefore are conducive to long times on stream between regenerations by burning carbonaceous deposits with oxygen-containing gas such as air.

An important characteristic of the crystal structure of this novel class of zeolites is that it provides a selective constrained access to and egress from the intracrystalline free space by virtue of having an effective pore size intermediate between the small pore Linde A and the large pore Linde X, i.e. the pore windows of the structure are of about a size such as would be provided by 10-membered rings of silicon atoms interconnected by oxygen atoms. It is to be understood, of course, that these rings are those formed by the regular disposition of the tetrahedra making up the anionic framework of the crystalline zeolite, the oxygen atoms themselves being bonded to the silicon (or aluminum, etc.) atoms at the centers of the tetrahedra.

The silica to alumina mole ratio referred to may be determined by conventional analysis. This ratio is meant to represent, as closely as possible, the ratio in the rigid anionic framework of the zeolite crystal and to exclude aluminum in the binder or in cationic or other form within the channels. Although zeolites with a silica to alumina mole ratio of at least 12 are useful, it is preferred in some instances to use zeolites having substantially higher silica/alumina ratios, e.g. 1600 and above. In addition, zeolites as otherwise characterized herein but which are substantially free of aluminum, that is zeolites having silica to alumina mole ratios of up to infinity, are found to be useful and even preferable in some instances. Such "high silica" or "highly siliceous" zeolites are intended to be included within this description. Also to be included within this definition are substantially pure silica analogs of the useful zeolites described herein, that is to say those zeolites having no measurable amount of aluminum (silica to alumina mole ratio of infinity) but which otherwise embody the characteristics disclosed.

The novel class of zeolites, after activation, acquire an intracrystalline sorption capacity for normal hexane which is greater than that for water, i.e. they exhibit "hydrophobic" properties. This hydrophobic character can be used to advantage in some applications.

The novel class of zeolites useful herein have an effective pore size such as to freely sorb normal hexane. In addition, the structure must provide constrained access to larger molecules. It is sometimes possible to judge from a known crystal structure whether such constrained access exists. For example, if the only pore windows in a crystal are formed by 8-membered rings of silicon and aluminum atoms, then access by molecules of larger cross-section than normal hexane is excluded and the zeolite is not of the desired type. Windows of 10-membered rings are preferred, although in some instances excessive puckering of the rings or pore blockage may render these zeolites ineffective.

Although 12-membered rings in theory would not offer sufficient constraint to produce advantageous conversions, it is noted that the puckered 12-ring structure of TMA offretite does show some constrained access. Other 12-ring structures may exist which may be operative for other reasons and, therefore, it is not the present intention to entirely judge the usefulness of a particular zeolite solely from theoretical structural considerations.

Rather than attempt to judge from crystal structure whether or not a zeolite possesses the necessary constrained access to molecules of larger cross-section than normal paraffins, a simple determination of the "Constraint Index" as herein defined may be made by passing continuously a mixture of an equal weight of normal hexane and 3-methylpentane over a sample of zeolite at atmospheric pressure according to the following procedure. A sample of the zeolite, in the form of pellets or extrudate, is crushed to a particle size about that of coarse sand and mounted in a glass tube. Prior to testing, the zeolite is treated with a stream of air at 540° C. for at least 15 minutes. The zeolite is then flushed with helium and the temperature is adjusted between 290° C. and 510° C. to give an overall conversion of between 10 percent and 60 percent. The mixture of hydrocarbons is passed at 1 liquid hourly space velocity (i.e., 1 volume of liquid hydrocarbon per volume of zeolite per hour) over the zeolite with a helium dilution to give a helium to (total) hydrocarbon mole ratio of 4:1. After 20 minutes on stream, a sample of the effluent is taken and analyzed, most conveniently by gas chromatography, to determine the fraction remaining unchanged for each of the two hydrocarbons.

While the above experimental procedure will enable one to achieve the desired overall conversion of 10 to 60 percent for most zeolite samples and represents preferred conditions, it may occasionally be necessary to use somewhat more severe conditions for samples of very low activity, such as those having an exceptionally high silica to alumina mole ratio. In those instances, a temperature of up to about 540° C. and a liquid hourly space velocity of less than one, such as 0.1 or less, can be employed in order to achieve a minimum total conversion of about 10 percent.

The "Constraint Index" is calculated as follows:

$$\text{Constraint Index} = \frac{\log_{10}(\text{fraction of hexane remaining})}{\log_{10}(\text{fraction of 3-methylpentane remaining})}$$

The Constraint Index approximates the ratio of the cracking rate constants for the two hydrocarbons. Zeolites suitable for the present invention are those having a Constraint Index of 1 to 12. Constraint Index (CI) values for some typical materials are:

TABLE 1

| | C.I. |
|---|---|
| ZSM-4 | 0.5 |
| ZSM-5 | 8.3 |
| ZSM-11 | 8.7 |
| ZSM-12 | 2 |
| ZSM-23 | 9.1 |
| ZSM-35 | 4.5 |
| ZSM-38 | 2 |
| ZSM-48 | 3.4 |
| TMA Offretite | 3.7 |
| Clinoptilolite | 3.4 |
| Beta | 0.6 |
| H—Zeolon (mordenite) | 0.4 |
| REY | 0.4 |
| Amorphous Silica-Alumina | 0.6 |
| Erionite | 38 |

The above-described Constraint Index is an important and even critical definition of those zeolites which are useful in the instant invention. The very nature of this parameter and the recited technique by which it is determined, however, admit of the possibility that a given zeolite can be tested under somewhat different conditions and thereby exhibit different Constraint Indices. Constraint Index seems to vary somewhat with severity of operation (conversion) and the presence or absence of binders. Likewise, other variables such as crystal size of the zeolite, the presence of occluded contaminants, etc., may affect the constraint index. Therefore, it will be appreciated that it may be possible to so select test conditions as to establish more than one value in the range of 1 to 12 for the Constraint Index of a particular zeolite. Such a zeolite exhibits the constrained access as herein defined and is to be regarded as having a Constraint Index in the range of 1 to 12. Also contemplated herein as having a Constraint Index in the range of 1 to 12 and therefore within the scope of the defined novel class of highly siliceous zeolites are those zeolites which, when tested under two or more sets of conditions within the above-specified ranges of temperature and conversion, produce a value of the Constraint Index slightly less than 1, e.g. 0.9, or somewhat greater than 12, e.g. 14 or 15, with at least one other value within the range of 1 to 12. Thus, it should be understood that the Constraint Index value as used herein is an inclusive rather than an exclusive value. That is, a crystalline zeolite when identified by any combination of conditions within the testing definition set forth herein as having a Constraint Index in the range of 1 to 12 is intended to be included in the instant novel zeolite definition whether or not the same identical zeolite, when tested under other of the defined conditions, may give a Constraint Index value outside of the range of 1 to 12.

The novel class of zeolites defined herein is exemplified by ZSM-5, ZSM-11, ZSM-12, ZSM-23, ZSM-35, ZSM-38, ZSM-48 and other similar materials.

ZSM-5 is described in greater detail in U.S. Pat. Nos. 3,702,886 and Re. 29,948. The entire descriptions contained within those patents, particularly the X-ray diffraction pattern of therein disclosed ZSM-5, are incorporated herein by reference.

ZSM-11 is described in U.S. Pat. No. 3,709,979. That description, and in particular the X-ray diffraction pattern of said ZSM-11, is incorporated herein by reference.

ZSM-12 is described in U.S. Pat. No. 3,832,449. That description, and in particular the X-ray diffraction pattern disclosed therein, is incorporated herein by reference.

ZSM-23 is described in U.S. Pat. No. 4,076,842. The entire content thereof, particularly the specification of the X-ray diffraction pattern of the disclosed zeolite, is incorporated herein by reference.

ZSM-35 is described in U.S. Pat. No. 4,016,245. The description of that zeolite, and particularly the X-ray diffraction pattern thereof, is incorporated herein by reference.

ZSM-38 is more particularly described in U.S. Pat. No. 4,046,859. The description of that zeolite, and particularly the specified X-ray diffraction pattern thereof, is incorporated herein by reference.

ZSM-48 can be identified, in terms of moles of anhydrous oxides per 100 moles of silica, as follows:

$(0\text{–}15)RN: (0\text{–}1.5)M_{2/n}O: (0\text{–}2)Al_2O_3:(100)SiO_2$ wherein:

M is at least one cation having a valence n; and

RN is a $C_1$–$C_{20}$ organic compound having at least one amine functional group of $pK_a \geqq 7$.

It is recognized that, particularly when the composition contains tetrahedral, framework aluminum, a fraction of the amine functional groups may be protonated. The doubly protonated form, in conventional notation, would be $(RNH)_2O$ and is equivalent in stoichiometry to $2RN+H_2O$.

The characteristic X-ray diffraction pattern of the synthetic zeolite ZSM-48 has the following significant lines:

TABLE 2

| Characteristic Lines of ZSM-48 | |
|---|---|
| d (Angstroms) | Relative Intensity |
| 11.9 | W-S |
| 10.2 | W |
| 7.2 | W |
| 5.9 | W |
| 4.2 | VS |
| 3.9 | VS |
| 3.6 | W |
| 2.85 | W |

These values were determined by standard techniques. The radiation was the K-alpha doublet of copper, and a scintillation counter spectrometer with a strip chart pen recorder was used. The peak heights, I, and the positions as a function of 2 times theta, where theta is the Bragg angle, were read from the spectrometer chart. From these, the relative intensities, $100\ I/I_o$, where $I_o$ is the intensity of the strongest line or peak, and d (obs.), the interplanar spacing in A, corresponding to the recorded lines, were calculated. In the foregoing table the relative intensities are given in terms of the symbols W=weak, VS=very strong and W-S=weak-to-strong. Ion exchange of the sodium with cations reveals substantially the same pattern with some minor shifts in interplanar spacing and variation in relative intensity. Other minor variations can occur depending on the silicon to aluminum ratio of the particular sample, as well as if it has been subjected to thermal treatment.

The ZSM-48 can be prepared from a reaction mixture containing a source of silica, water, RN, an alkali metal oxide (e.g. sodium) and optionally alumina. The reaction mixture should have a composition, in terms of mole ratios of oxides, falling within the following ranges:

TABLE 3

| REACTANTS | BROAD | PREFERRED |
|---|---|---|
| $Al_2O_3/SiO_2$ = | 0 to 0.02 | 0 to 0.01 |
| $Na/SiO_2$ = | 0 to 2 | 0.1 to 1.0 |
| $RN/SiO_2$ = | 0.01 to 2.0 | 0.05 to 1.0 |
| $OH^-/SiO_2$ = | 0 to 0.25 | 0 to 0.1 |
| $H_2O/SiO_2$ = | 10 to 100 | 20 to 70 |
| $H^+$(added)/$SiO_2$ = | 0 to 0.2 | 0 to 0.05 |

wherein RN is a $C_1$–$C_{20}$ organic compound having amine functional group of $pK_a \geqq 7$. The mixture is maintained at 80°–250° C. until crystals of the material are formed. $H^+$ (added) is moles acid added in excess of the moles of hydroxide added. In calculating $H^+$(added) and OH values, the term acid ($H^+$) includes both hydronium ion, whether free or coordinated, and aluminum. Thus aluminum sulfate, for example, would be considered a mixture of aluminum oxide, sulfuric acid, and water. An amine hydrochloride would be a mixture of amine and HCl. In preparing the highly siliceous form of ZSM-48 no alumina is added. Thus, the only aluminum present occurs as an impurity in the reactants.

Preferably, crystallization is carried out under pressure in an autoclave or static bomb reactor at 80° C. to 250° C. Thereafter, the crystals are separated from the liquid and recovered. The composition can be prepared utilizing materials which supply the appropriate oxide. Such compositions include sodium silicate, silica hydrosol, silica gel, silicic acid, RN, sodium hydroxide, sodium chloride, aluminum sulfate, sodium aluminate, aluminum oxide, or aluminum itself. RN is a $C_1$–$C_{20}$ organic compound containing at least one amine functional group of $pK_a \geqq 7$, as defined above, and includes such compounds as $C_3$–$C_{18}$ primary, secondary, and tertiary amines, cyclic amine (such as piperidine, pyrrolidine and piperazine), and polyamines such as $NH_2—C_nH_{2n}—NH_2$ wherein n is 4–12.

The original cations can be subsequently replaced, at least in part, by calcination and/or ion exchange with another cation. Thus, the original cations are exchanged into a hydrogen or hydrogen ion precursor form or a form in which the original cation has been replaced by a metal of Groups II through VIII of the Periodic Table. Thus, for example, it is contemplated to exchange the original cations with ammonium ions or with hydronium ions. Catalytically active forms of these would include, in particular, hydrogen, rare earth metals, aluminum, manganese and other metals of Groups II and VIII of the Periodic Table.

It is to be understood that by incorporating by reference the foregoing patents to describe examples of specific members of the novel class with greater particularity, it is intended that identification of the therein disclosed crystalline zeolites be resolved on the basis of their respective X-ray diffraction patterns. As discussed above, the present invention contemplates utilization of such catalysts wherein the mole ratio of silica to alumina is essentially unbounded. The incorporation of the identified patents should therefore not be construed as limiting the disclosed crystalline zeolites to those having the specific silica-alumina mole ratios discussed therein, it now being known that such zeolites may be substantially aluminum-free and yet, having the same crystal structure as the disclosed materials, may be useful or even preferred in some applications. It is the crystal structure, as identified by the X-ray diffraction "fingerprint", which establishes the identity of the specific crystalline zeolite material.

The specific zeolites described, when prepared in the presence of organic cations, are substantially catalytically inactive, possibly because the intracrystalline free space is occupied by organic cations from the forming solution. They may be activated by heating in an inert atmosphere at 540° C. for one hour, for example, followed by base exchange with ammonium salts followed by calcination at 540° C. in air. The presence of organic cations in the forming solution may not be absolutely essential to the formation of this type zeolite; however, the presence of these cations does appear to favor the formation of this special class of zeolite. More generally, it is desirable to activate this type catalyst by base exchange with ammonium salts followed by calcination in air at about 540° C. for from about 15 minutes to about 24 hours.

Natural zeolites may sometimes be converted to zeolite structures of the class herein identified by various activation procedures and other treatments such as base exchange, steaming, alumina extraction and calcination, alone or in combinations. Natural minerals which may be so treated include ferrierite, brewsterite, stilbite, dachiardite, epistilbite, heulandite, and clinoptilolite.

The preferred crystalline zeolites for utilization herein include ZSM-5, ZSM-11, ZSM-12, ZSM-23, ZSM-35, ZSM-38, and ZSM-48, with ZSM-5 and ZSM-11 being particularly preferred.

In a preferred aspect of this invention, the zeolites hereof are selected as those providing among other things a crystal framework density, in the dry hydrogen form, of not less than about 1.6 grams per cubic centimeter. It has been found that zeolites which satisfy all three of the discussed criteria are most desired for several reasons. When hydrocarbon products or by products are catalytically formed, for example, such zeolites tend to maximize the production of gasoline boiling range hydrocarbon products. Therefore, the preferred zeolites useful with respect to this invention are those having a Constraint Index as defined above of about 1 to about 12, a silica to alumina mole ratio of at least about 12 and a dried crystal density of not less than about 1.6 grams per cubic centimeter. The dry density for known structures may be calculated from the number of silicon plus aluminum atoms per 1000 cubic Angstroms, as given, e.g., on Page 19 of the article ZEOLITE STRUCTURE by W. M. Meier. This paper, the entire contents of which are incorporated herein by reference, is included in PROCEEDINGS OF THE CONFERENCE ON MOLECULAR SIEVES, (London, April 1967) published by the Society of Chemical Industry, London, 1968.

When the crystal structure is unknown, the crystal framework density may be determined by classical pycnometer techniques. For example, it may be determined by immersing the dry hydrogen form of the zeolite in an organic solvent which is not sorbed by the crystal. Or, the crystal density may be determined by mercury porosimetry, since mercury will fill the interstices between crystals but will not penetrate the intracrystalline free space.

It is possible that the unusual sustained activity and stability of this special class of zeolites is associated with its high crystal anionic framework density of not less than about 1.6 grams per cubic centimeter. This high density must necessarily be associated with a relatively small amount of free space within the crystal, which might be expected to result in more stable structures. This free space, however, is important as the locus of catalytic activity.

Crystal framework densities of some typical zeolites, including some which are not within the purview of this invention, are:

TABLE 4

| | Void Volume | Framework Density |
|---|---|---|
| Ferrierite | 0.28 cc/cc | 1.76 g/cc |
| Mordenite | .28 | 1.7 |
| ZSM-5, -11 | .29 | 1.79 |
| ZSM-12 | — | 1.8 |
| ZSM-23 | — | 2.0 |
| Dachiardite | .32 | 1.72 |
| L | .32 | 1.61 |
| Clinoptilolite | .34 | 1.71 |
| Laumontite | .34 | 1.77 |
| ZSM-4 (Omega) | .38 | 1.65 |
| Heulandite | .39 | 1.69 |
| P | .41 | 1.57 |
| Offretite | .40 | 1.55 |
| Levynite | .40 | 1.54 |
| Erionite | .35 | 1.51 |
| Gmelinite | .44 | 1.46 |
| Chabazite | .47 | 1.45 |
| A | .5 | 1.3 |
| Y | .48 | 1.27 |

When synthesized in the alkali metal form, the zeolite is conveniently converted to the hydrogen form, generally by intermediate formation of the ammonium form as a result of ammonium ion exchange and calcination of the ammonium form to yield the hydrogen form. In addition to the hydrogen form, other forms of the zeolite wherein the original alkali metal has been reduced to less than about 1.5 percent by weight may be used. Thus, the original alkali metal of the zeolite may be replaced by ion exchange with other suitable metal cations of Groups I through VIII of the Periodic Table, including, by way of example, nickel, copper, zinc, palladium, calcium or rare earth metals.

In practicing a particularly desired chemical conversion process, it may be useful to incorporate the above-described crystalline zeolite with a matrix comprising another material resistant to the temperature and other conditions employed in the process. Such matrix material is useful as a binder and imparts greater resistance to the catalyst for the severe temperature, pressure and reactant feed stream velocity conditions encountered in many cracking processes.

Useful matrix materials include both synthetic and naturally occurring substances, as well as inorganic materials such as clay, silica and/or metal oxides. The latter may be either naturally occurring or in the form of gelatinous precipitates or gels including mixtures of silica and metal oxides. Naturally occurring clays which can be composited with the zeolite include those of the montmorillonite and kaolin families, which families include the sub-bentonites and the kaolins commonly known as Dixie, McNamee-Georgia and Florida clays or others in which the main mineral constituent is halloysite, kaolinite, dickite, nacrite or anauxite. Such clays can be used in the raw state as originally mined or initially subjected to calcination, acid treatment or chemical modification.

In addition to the foregoing materials, the zeolites employed herein may be composited with a porous matrix material, such as alumina, silica-alumina, silica-magnesia, silica-zirconia, silica-thoria, silica-beryllia, and silica-titania, as well as ternary compositions, such as silica-alumina-thoria, silica-alumina-zirconia, silica-alumina-magnesia and silica-magnesia-zirconia. The matrix may be in the form of a cogel. The relative proportions of zeolite component and inorganic oxide gel matrix, on an anhydrous basis, may vary widely with the zeolite content ranging from between about 1 to about 99 percent by weight and more usually in the range of about 5 to about 80 percent by weight of the dry composite.

As has been stated, the zeolites used in this invention may have the original cations associated therewith wholly or partly replaced by a wide variety of other cations according to techniques well known in the art, as by ion exchange. Typical replacing cations include hydrogen, ammonium, and metal cations including mixtures of the same. Of the replacing cations, particular preference is given to cations of hydrogen, alkali, ammonium, rare earth, magnesium, calcium, zinc, copper, silver, platinum, palladium, nickel and mixtures thereof. The metals may be also added by impregnation.

Typical ion exchange techniques include contacting the particular zeolite with a salt of the desired replacing cation or cations. Although a wide variety of salts can be employed, particular preference is given to chlorides, nitrates and sulfates. Pd and Pt can also be exchanged via their tetramine complex ions.

Representative ion exchange techniques are disclosed in a wide variety of patents, including U.S. Pat. Nos. 3,140,249; 3,140,251; and 3,140,253.

After contact of the crude with the catalyst disclosed, the second step is carried out to prevent phase separation. Thus, the catalytically-treated crude is cooled to a temperature of from about 200° F. to about 210° F. to give one uniform material containing a small amount (about 1 to 2 percent by weight) of high melting point hydrocarbons which are removed by filtration. Further cooling to a temperature of about 130° F. to 135° F. results in a product having an additional small quantity (about 4 to 5 percent by weight) of wax, which is removed by filtration. The effluent is a uniform fluid having a reduced pour point and no further tendency to separate into two phases.

Having described the invention in broad terms, the following will specifically illustrate same.

EXAMPLE

The catalyst was prepared by contacting the ammonium form of ZSM-5 extrudate commercially obtained with 100 percent steam at 850° F. for 16 hours. The steam treated product was added to a 1 N $NH_4NO_3$ solution, pH4. The mixture was maintained at 200° F. for 4 hours with continuous stirring, then the liquid was decanted and the catalyst was washed with de-ionized water. The resulting catalyst was then Na-exchanged (pH of exchange 8–9) to an alpha value of about 0.3.

Altamont whole crude (see Table 5) was processed over the catalyst at 650°–730° F., 1 LHSV, at 300 psig and in the absence of added gas. A sample of dewaxed crude was subjected to filtration as set forth in Table 6. It is clear that the new filtration steps have produced a uniform dewaxed product with low pour point. The major distinction of the present concept is that we have discovered a two-step process rendering waxy crudes pumpable.

The acid activity of zeolite catalysts is conveniently defined by the alpha scale described in an article published in the Journal of Catalysis, Vol. VI, pp. 278–287 (1966). In this test, the zeolite catalyst is contacted with hexane under conditions prescribed in the publication and the amount of hexane which is cracked is measured. From this measurement is computed an "alpha" value which characterizes the catalyst for its cracking activity for hexane. The entire article above referred to is incorporated herein by reference. The alpha scale so described will be used herein to define activity levels for cracking n-hexane. And, in particular, for purposes of this invention, a catalyst with an alpha value of not greater than about 1.0 and preferably not greater than about 0.5 will be considered to have substantially no activity for cracking n-hexane.

TABLE 5

PROPERTIES OF ALTAMONT CRUDE

| Description | Results |
|---|---|
| Elemental Analysis, Weight Percent | |
| Carbon | 85.3 |
| Hydrogen | 13.8[a] |
| Nitrogen-Chemiluminesce, ppm | 41 |
| Nickel, ppm | <1 |
| Vanadium, ppm | <1 |
| Sulfur, Percent Weight | 0.03 |
| Distillation, Weight Percent | |
| IBP-330° F. | 6 |
| 330–800° F. | 45 |
| 800° F.+ | 49 |

TABLE 5-continued

| PROPERTIES OF ALTAMONT CRUDE | |
|---|---|
| Description | Results |
| Pour Point, °F. | >115 |

[a]Average of two determinations

TABLE 6

| | |
|---|---|
| Reaction Temp., °F. | 730 |
| LHSV | 0.8 |
| Time on Stream, Days | 27 |
| System Pressure, Psig | 300 |
| Liquid Product Pour Point, °F. | |
| Upper Layer | −10 |
| Bottom Layer | 50 |
| Pour Point after Filtration | |
| at 130° F., °F. | 15 |
| Solid Held on Filter Paper, Percent Weight | 4 |
| Net Yield, Percent Weight | |
| $C_4^-$ | 4.5 |
| IBP - 330° F. | 43.5 |
| 330–800° F. | 35.0 |
| 800° F.+ | 13.0 |
| Solids | 4.0 |
| TOTAL | 100 |

Table 7 presents an elemental analysis of the filtered solids.

TABLE 7

| Elemental Analysis of the Filtered Solid (Sludge) | | |
|---|---|---|
| Weight Percent | Feed | Sludge |
| Carbon | 85.3 | 86.30 |
| Hydrogen | 13.8[a] | 13.54 |
| Nitrogen, ppm | 41 | 400 |
| Sulfur | .03 | .07 |

[a]Average of two determinations

Detailed properties of dewaxed and filtered Altamont crude are shown in Table 6. Compared to whole crude, the dewaxed product exhibited an increase in the yield of the IBP-330° F. fraction, an increase in the 330°–800° F. distillate and a drastic reduction in the 800° F.+ residue. The dewaxed crude was, however, a cloudy liquid which separated into two phases upon storage. Because of this phase separation pour point measurements on the total product were not consistent. It is estimated that the pour point of dewaxed crude was about 35° F. Upon phase separation the observed pour points of the upper and lower layers were −10° F. and +50° F., respectively.

In an effort to understand this phase separation, a brief compositional study of the dewaxed crude was undertaken. A sample of the dewaxed crude was centrifuged and the sludge (solid) subjected to C-13 NMR analysis. In interpreting the NMR spectra, it is necessary to use model compound chemical shifts for the delineation of complex mixtures. The carbons at 11.8, 28 and 40.5 δ's indicate the presence of interior ethyl branching.

The sludge removed by the centrifuge is organic in nature as was indicated by its solubility in organic solvents, e.g., heptane and toluene. C-13 NMR analysis showed that the sludge contains ~85 percent paraffinic and 15 percent non-paraffinic carbon, probably aromatic and alicyclic in nature. Based on NMR chemical shifts, it is estimated that about ~80 percent of the paraffinic carbon in the sludge is in the form of long methylene chains and it is thus postulated that more severe processing conditions may help in solving this phase separation problem.

An alternative to an increase in severity is the removal of the sludge from the processed crude. It was observed that by filtering the dewaxed crude through filter paper (Whatman 2 V folded) at 130° F., a homogeneous liquid with a 15° F. pour point was collected and an organic solid (4 percent by weight) was held by the filter paper. Evidence for the organic nature of the solid was indicated by its partial solubility at room temperature in organic solvents, e.g., toluene and heptane, and its complete solubility in warm (>100° F.) toluene and heptane. Similar filtration at 195° F. was carried out. At this higher temperature, 1 percent solid was removed, however, filtrate phase separation was observed upon cooling to 130° F.

Elemental analysis of the solid removed by filtration at 130° F. (Table 7) shows that the composition of the solid is similar to that of the whole crude except in nitrogen-content. Whereas the whole crude contains 41 ppm N, the 4 percent solid contains about 400 ppm. This corresponds to the concentration of half the nitrogen content of the feed in a very small fraction of the dewaxed product.

We claim:

1. An improved two-step catalytic process for preparing crude oil for transport, the improvement comprising (1) in a first stage contacting at from about 50 to about 500 psig, a LHSV of from about 0.1 to about 2 and a temperature of from about 500° F. to about 800° F., said crude oil with a crystalline aluminosilicate zeolite having a $SiO_2$ to $Al_2O_3$ ratio of at least 12, a constraint index of about 1 to 12, and an alpha value no greater than about one, to substantially dewax said crude oil, the contact being made in the absence or presence of added hydrogen and thereafter cooling said substantially dewaxed crude oil in stages in a temperature of from about 210° F. to about 130° F. and (2) in a second stage filtering said cooled and substantially dewaxed oil thereby separating high melting point hydrocarbons and other organic solids therefrom.

2. The process of claim 1 wherein the zeolite is HZSM-5.

3. The process of claim 2 wherein the zeolite is alkali metal ZSM-5.

4. The process of claims 1, 2 or 3 wherein the process of step (1) is carried out at from about 375 to about 450 psig, a LHSV of from about 0.8 to about 1.2 and a temperature of from about 700° F. to about 750° F.

5. The process of claim 4 wherein, prior to step (2) substantially the dewaxed crude is cooled in stages to a final temperature of about 130° F.

6. An improved two step catalytic process for preparing crude oil for transport, the improvement comprising (1) in a first stage contacting at from about 50 to about 500 psig, a LHSV of from about 0.1 to about 2 and a temperature of from about 500° F. to about 800° F., said crude oil with a crystalline aluminosilicate zeolite having a $SiO_2$ to $AL_2O_3$ ratio of at least 12, a constraint index of about 1 , to 12, to substantially dewax said crude oil, the contact being made in the absence or presence of added hydrogen and thereafter cooling said substantially dewaxed crude oil in stages to a temperature of from about 210° F. to about 130° F. and (2) in a second stage filtering said cooling and substantially dewaxed oil thereby separating high melting point hydrocarbons and other organic solids therefrom.

* * * * *